United States Patent [19]

Sykes

[11] 4,156,442

[45] May 29, 1979

[54] LOCATING MEANS FOR CO-OPERATING WITH HELICAL WIRES

[75] Inventor: Neville Sykes, New Mills via Stockport, England

[73] Assignee: Multilastic Limited, West Midlands, England

[21] Appl. No.: 857,171

[22] Filed: Dec. 2, 1977

[51] Int. Cl.[2] ..... B21F 23/00

[52] U.S. Cl. ..... 140/92.94; 226/196

[58] Field of Search ..... 140/92.94, 92.3, 92.4, 140/92.7, 92.8, 92.9; 226/196

[56] References Cited

U.S. PATENT DOCUMENTS

| | | | |
|---|---|---|---|
| 464,693 | 12/1891 | Frost | 140/92.94 |
| 1,881,672 | 10/1932 | Kirchner | 140/92.4 |

*Primary Examiner*—Lowell A. Larson

*Attorney, Agent, or Firm*—Scrivener, Parker, Scrivener & Clarke

[57] ABSTRACT

The invention provides a pair of bodies with operative faces that can be brought face to face. The operative face of one body is formed with a row of circular openings of uniform diameter and spaced uniformly apart. The operative face of the other body has a row of locating formations which may also comprise a row of circular openings similar to those in said one body. The openings and formations are together such as to define a passageway for receiving and locating a helical wire of pitch equal to the spacing between the centers of the openings in said one body. The helical wire can be advanced axially relative to the bodies by rotating it about its own axis.

5 Claims, 11 Drawing Figures

LOCATING MEANS FOR CO-OPERATING WITH HELICAL WIRES

Figure 1:
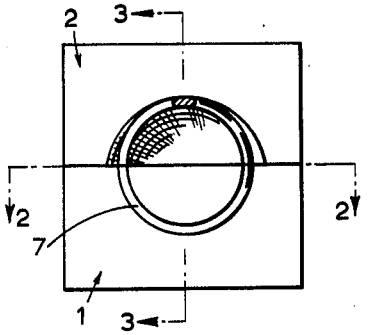

This invention relates to locating means for co-operating with helical wires.

The nature and purpose of the invention can well be understood by considering them in relation to the manufacture of spring interiors for mattresses and other articles of furniture, but, as will become apparent from the description that follows, the invention is also of application to other types of manufacture.

One well-known type of spring interior comprises a plurality of coil springs disposed in an array with their axes parallel or substantially parallel with one another. The ends of the springs define the two principal faces of the spring interior, those faces usually being mutually parallel. The individual coil springs are linked together by means of helical wires, the diameter and pitch of the helical wires being considerably less than those of the coil springs. There are two sets of helical wires, one set lying in one of the principal faces and the other set lying in the other principal face of the spring interior. The helical wires of each set are mutually parallel and are spaced apart at uniform intervals. Each helical wire embraces arcuate lengths of wire constituting portions of the ends of the coil springs; and in this way the coil springs are secured together.

In the manufacture of a spring interior of the kind described it is usual for two rows of coil springs to be arranged side-by-side and for the adjacent portions of the ends of the springs to be gripped between pairs of jaws which thus locate them. Each jaw is formed with a longitudinal groove, and the arrangement is such that when a pair of jaws is closed the grooves co-operate to form a cylindrical hole through which extend the arcuate portions of the coil springs to be linked together. The cylindrical holes formed in the row of pairs of jaws are mutually aligned.

Each jaw is also formed internally with a plurality of guide formations, the arrangement being such that when a pair of jaws is closed the guide formations in the jaws co-operate to define a substantially continuous generally helical passageway co-axial with the cylindrical hole. The guide formations may comprise part-helical grooves or they may be in the shape of inclined slots or cavities. Nevertheless the arrangement is in each case such that when the jaws are closed the guide formations together define a passageway of generally helical shape. Each jaw may be of unitary construction or may be fabricated from a plurality of separate components. In use the pairs of jaws are opened, portions of the ends of adjacent coil springs are introduced between them and they are closed. A helical wire is then passed axially through the helical or substantially helical passageway and thus embraces the portions of the coil springs between the jaws. The jaws are opened again and the helical wire and the wires linked to it are removed.

During that assembly the helical wire is introduced into one end of the passageway and is simultaneously rotated and moved axially so that it advances much in the same manner as a screw being inserted into a threaded hole.

The disadvantages of the construction described above are that the jaws are awkward and expensive to manufacture and that the jaws offer considerable resistance to the advancing helical wire. An aim of the present invention is to overcome or reduce those disadvantages.

According to the present invention there is provided locating means for co-operating with helical wires, comprising a pair of bodies which are or can be disposed in face-to-face relationship with operative faces either abutting each other or spaced a little apart from each other, the operative face of the first of the bodies being formed with a row of circular openings of uniform diameter and spaced uniformly apart, and the operative face of the second of the bodies having a row of locating formations, the arrangement being such that when the bodies are disposed in face-to-face relationship the two rows extend side-by-side and said openings and locating formations together define a passageway which can receive and locate a helical wire of pitch equal to the spacing between the centres of said openings, it being possible to advance the helical wire axially by relative rotation between the helical wire and the bodies about the axis of the helical wire.

It would be possible to use a body with a row of openings characteristic of the present invention in conjunction with a body formed with part-helical grooves or other locating formations, such as a body of a known kind, but such an arrangement is not preferred. In a preferred arrangement, on the other hand, the row of locating formations of said second body comprises a row of circular openings of uniform diameter equal to the diameter of the openings in said first body, and spaced uniformly apart at a spacing equal to the spacing of the openings in said first body, the openings in the rows being symmetrically offset lengthwise of the rows so that each opening in one row is half way between a pair of openings in the other row, the openings overlapping to enable the helical wire to extend from each opening in one body to the next opening in the other body.

Each of the two bodies is preferably made as a unitary whole, though it would be within the scope of the invention to use bodies each made from several components secured together.

The operative faces of the bodies would normally be planar, but this is not essential. Nevertheless the arrangement should be such that the overlapping edges of the openings in the bodies lie close to a common plane if thus do not actually lie in a common plane. If the edges of the openings lie in a common plane it will be appreciated that between an opening in one body and the next opening in the other body there is an aperture defined by two convex arcs of the same radius. Thus in the common plane there is a row of apertures of that shape, the line joining the two pointed ends of any of the apertures being normal to the longitudinal axis of the row. When a helical wire is located by the bodies it extends from an opening on one side of the plane to the next opening on the other side of the plane by way of the associated aperture; and it extends to the next opening on said one side by way of the next aperture. Thus at each half turn the helical wire extends through the next successive aperture in the row. The diameter of the helix is preferably such that the wire is constrained to pass closely adjacent to the pointed ends of the apertures, the wire extending through alternate apertures near the pointed ends thereof to one side of the longitudinal axis of the row of apertures, and through the remaining apertures near the pointed ends thereof to the other side of that axis. If a helical wire of smaller diameter is used the wire is less positively located so that its axis can shift laterally to some extent.

The interiors of the openings may be of any suitable shape, and the openings may be blind or may open through the bodies. Preferably each of the openings comprises a blind hole, of a depth such that in use the helical wire touches the inner end of each opening. The holes may, for example, by cylindrical, but preferably they are part-spherical. The exact shape of hole required to engage the turns of a helix throughout its length can quite readily be calculated and somewhat resembles a hemisphere, though it is somewhat less deep than a true hemisphere.

An advantage of the present invention is that the openings can readily be formed in the body, or in components for the body, by means of a rotary cutting tool or rotary cutting tools, the axis of the tool or of each tool being at right angles to the row of openings. The term "circular opening" used in this specification and the appendant claims is intended to denote an opening which has been formed in that manner or is of a shape which could be formed in that manner.

The tool or each tool may comprise a drill, and the end of the drill may be of the conventional conical shape or may have been reshaped to cut an opening of part-spherical or approximately part-spherical shape.

In one method the openings in a body are formed simultaneously by a plurality of tools. In another method an opening or a group of adjacent openings is formed in one operation, the body is moved longitudinally relative to the tools and another opening or group of openings is formed, the process continuing until the desired number of openings has been formed. If openings are progressively formed in a longitudinally extensive body in this manner, the body may then be severed to form individual bodies each of lesser length. Whichever of these methods is used, however, it is preferred to arrange for each opening or group of openings to be formed at a predetermined distance from a fixed datum, for if each were formed at a given distance from the last there would be a tendency for cumulative errors to occur.

The invention also includes within its scope a body for use in locating means of the kind outlined above, having an operative face formed with a row of circular openings of uniform diameter and with their axes parallel and spaced uniformly apart.

Where two similar bodies are used in locating a helical wire it will be appreciated, from considerations of symmetry, that the bodies can locate a helical wire which is in the shape of a right-hand or a left-hand screw. This may sometimes be advantageous. For example, a machine for assembling spring interiors, and employing jaws in the form of bodies embodying the present invention, can be used with helical wires of either hand. It is thus possible for the machine to be used in the manufacture of spring interiors incorporating helical wires of both hands.

The foregoing description has referred to the use of the invention in relation to the manufacture of spring interiors. The invention has, however, numerous other uses. For example the invention may be used in a conveyor of the kind comprising a helical wire which rotates, but does not move axially, and serves to move carriers lengthwise of the conveyor. Each carrier can then comprise a pair of bodies in accordance with the invention. When they engage the rotating helical wire they are caused to move longitudinally. Goods or articles can be coupled to the carrier so that they move with it. Means may be provided near the ends of the helical wire and, if desired, at intermediate stations to cause the bodies to separate from one another and from the helical wire. The direction of rotation of the helical wire can be reversed so that a carrier can be caused to move in either direction along the wire.

Figure 2:
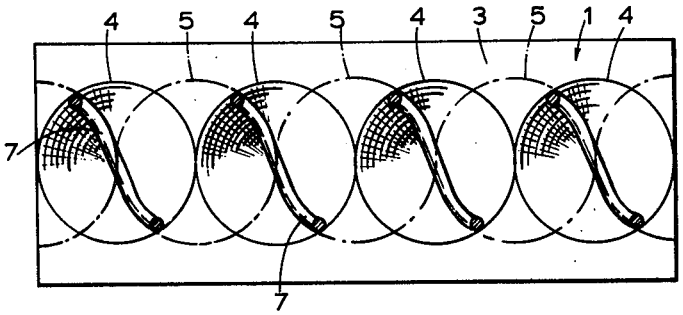
Figure 3:
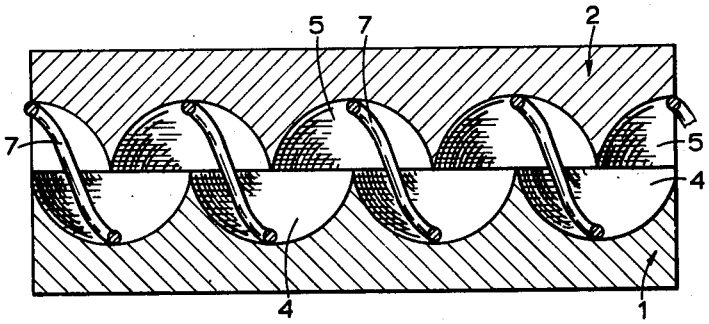
Figure 4:
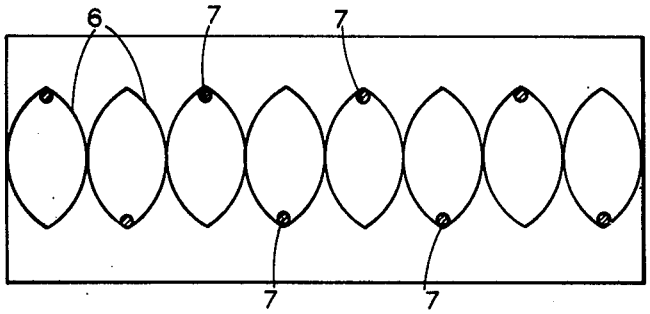
Figure 5:
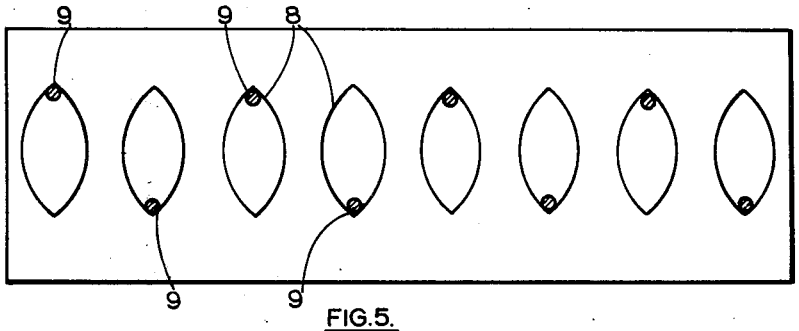
Figure 6:
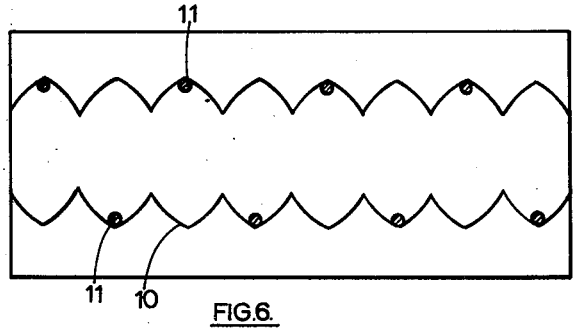
Figure 7:
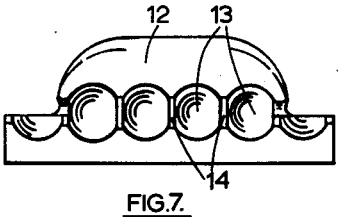
Figure 8:
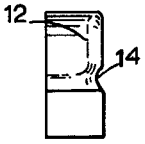
Figure 9:
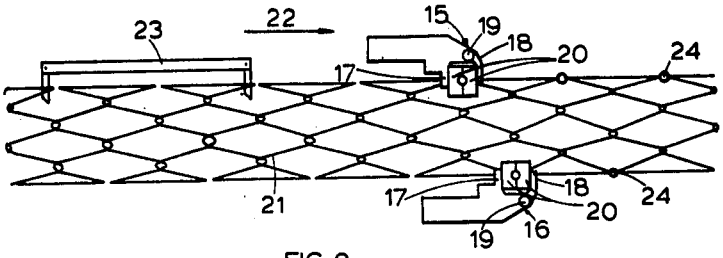
Figure 10:
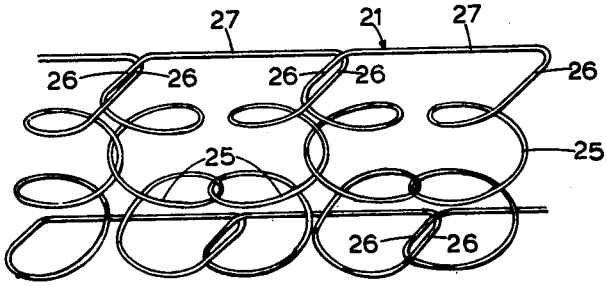
Figure 11:
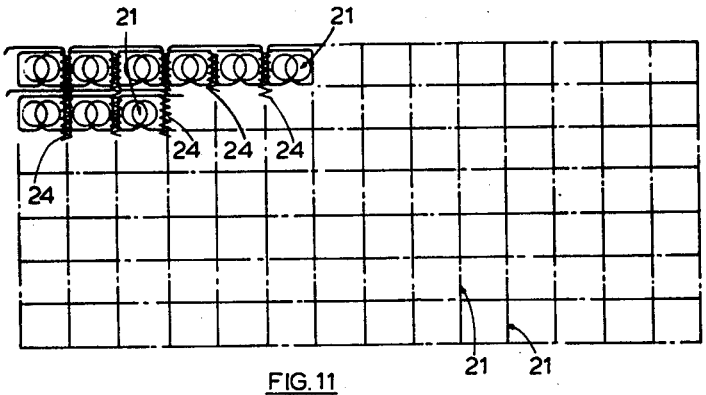

Embodiments of the invention will now be more particularly described, by way of example, with reference to the accompanying drawings, in which:

FIG. 1 is an end view of a pair of bodies constituting locating means for co-operating with a helical wire, the helical wire also being shown, FIG. 2 is a section along line 2—2 of FIG. 1, FIG. 3 is a section along line 3—3 of FIG. 1, FIG. 4 is a diagrammatic view of the apertures in the plane of the section 2—2 in FIG. 1, FIGS. 5 and 6 are similar to FIG. 4 but illustrate the shapes of the apertures when the spacing between the openings are respectively increased and decreased, FIG. 7 is a front view of a body embodying the present invention and intended for use as a jaw in apparatus for manufacturing spring interiors, FIG. 8 is an end view of the body shown in FIG. 7, as viewed from the left of FIG. 7, FIG. 9 is a diagrammatic side view of the operative parts of apparatus for use in manufacturing spring interiors, and including jaws with bodies of the kind shown in FIGS. 7 and 8, FIG. 10 is a perspective view of a band of springs shown diagrammatically in side view in FIG. 9, and FIG. 11 is a diagrammatic plan view of a spring interior made with the apparatus shown in FIG. 9.

The locating means shown in FIG. 1 comprises a pair of bodies 1 and 2 each of substantially similar form to the other. The body 1 has a planar operative face 3 formed with a row of circular openings 4 of uniform diameter. The openings are spaced uniformly apart, the distance between successive centres being equal to the diameter of the openings. Each opening is of part-spherical shape, being slightly shallower than a hemisphere. The openings are formed with the aid of a drill-like forming tool, the body being moved forward step-by-step after the formation of each successive opening.

The only difference between the bodies 1 and 2 is that the openings 5 in body 2 are symmetrically offset lengthwise with respect to the openings 4 in body 1 so that each opening 5 is half way between a pair of openings 4, and vice versa. The openings thus overlap with the result that apertures 6 of the shape shown in FIG. 4 are present in the plane of the operative faces of the bodies. Each aperture is defined by two convex arcs of the same radius.

A helical wire 7 extends between the bodies 1 and 2. As can be seen in FIG. 2 the half-turns of the wire to one side of the operative faces lie in the openings 4, the arrangement being such that the half-turns touch the bottoms or inner ends of the openings (as shown in FIG. 1). The half-turns in the openings 4 are joined to similar half-turns in the openings 5 through the ends of the apertures 6 as shown in FIGS. 2 and 4.

If the helical wire 7 is rotated relative to the bodies 1 and 2 the wire advances axially through the bodies in the manner of a screw. It will be appreciated that a helical wire of the opposite hand to the helical wire 7 could be substituted for the wire 7.

If the spacing between successive openings in each of the bodies 1 and 2 is increased the apertures in the common operative plane of the bodies would have the outlines indicated by the reference numerals 8 in FIG. 5. The bodies could then receive and locate a helical wire 9 of correspondingly increased pitch but of slightly reduced diameter. In view of the reduction in diameter it would be desirable to reduce the depth of the openings to an extent such that the wire 9 touched the bottoms or inner ends of the openings.

Conversely if the spacing between successive openings is decreased the apertures have the outlines with reference numerals 10 in FIG. 6. The bodies could then receive and locate a helical wire 11 of correspondingly decreased pitch and slightly increased diameter, but it would be necessary to increase the depth of the openings to accommodate that increase in diameter.

FIG. 7 shows a body 12 for use as a jaw in apparatus for manufacturing spring interiors. The body is intended for use with a similar jaw which differs only in that the openings in it are symmetrically offset lengthwise with respect to the openings 13 in the body 12. The openings 13 resemble the openings 4 in the body 1. The body 12 is formed from a length of bar in which a succession of openings 13 has been formed. The body is shaped as illustrated with the result that some parts of the body have only parts of openings. A longitudinal central groove 14 is formed in the body 12. In use, when the jaw abuts its complementary jaw the grooves in the bodies together constitute a channel through which extend portions of coil springs which are to form part of a spring interior. When a helical wire is then inserted through the openings it embraces those portions of the coil springs. The jaws can then be parted and the interconnected parts removed. It may appear at first sight that the openings 13 are not truly circular as defined above. This, however, is due to the fact that they are of part-spherical shape, and where they are intersected by the groove 14, the edge of the intersection is planar or substantially so.

Bodies of the kind shown in FIGS. 7 and 8 can be used in apparatus for use in manufacturing spring interiors. One known type of apparatus in which such bodies can be used is described and illustrated in British Pat. specification No. 1,095,980 of Multilastic Limited. The relevant parts of that apparatus are illustrated in FIG. 9 and comprise upper and lower sets of jaws 15 and 16 respectively. Each set has a fixed jaw 17 and a movable jaw 18 which is pivoted to the fixed jaw at 19. Each of the jaws 17 and 18 includes a body 20 of the kind shown in FIGS. 7 and 8.

Bands of springs 21 are moved forward stepwise, in the direction of the arrow 22, by reciprocating feed-means 23. After each forward movement the movable jaws 18, which has been open, are closed so that parts of the bands are trapped between the fixed and movable jaws as shown in FIG. 9. Helical wires are advanced axially through the jaws, entering the openings in the bodies 20 as described above. When the helical wires are in place the movable jaws 18 are opened and the feed means 23 is operated, thus causing the parts of the bands linked by the helical wires to move from the jaws and to bring between the jaws the next parts to be linked together. Helical wires already joined to the bands are indicated at 24.

One of the bands 21 from which the spring interior is formed is shown in FIG. 10. It comprises a single length of resilient wire so bent as to form a row of springs 25 with their axes inclined somewhat to the vertical. At its upper and lower end each spring 25 is integrally connected to a straight part 26 extending transversely of the band; these straight parts 26 are themselves integrally connected to connectors 27 which extend lengthwise of the band at the top and bottom faces thereof. Coils of adjacent springs 25 are interlinked as shown. During assembly of the spring interior it is the adjacent pairs of straight parts 26 of the band that are trapped between the jaws and linked together by the helical wires.

As shown in FIG. 11 the completed spring interior comprises a plurality of bands of springs 21, each similar to that shown in FIG. 10, disposed side-by-side and connected together by the helical wires 24.

I claim:

1. Locating means for co-operating with helical wires, comprising a pair of bodies which are or can be disposed in face-to-face relationship with operative faces either abutting each other or spaced a little apart from each other, the operative face of the first of the bodies being formed with a row of circular openings of uniform diameter and spaced uniformly apart with the axis of the openings being at right angles to said row of openings, and the operative face of the second of the bodies having a row of locating formations, the arrangement being such that when the bodies are disposed in face-to-face relationship the two rows extend side-by-side and said openings and locating formations together define a passageway which can receive and locate a helical wire of pitch equal to the spacing between the centers of said openings, it being possible to advance the helical wire axially by relative rotation between the helical wire and the bodies about the axis of the helical wire.

2. Locating means according to claim 1 in which the row of locating formations of said second body comprises a row of circular openings of uniform diameter equal to the diameter of the openings in said first body, and spaced uniformly apart at a spacing equal to the spacing of the openings in said first body, the openings in the rows being symmetrically offset lengthwise of the rows so that each opening in one row is half way between a pair of openings in the other row, the openings overlapping to enable the helical wire to extend from each opening in one body to the next opening in the other body.

3. Locating means according to claim 1 in which each of said openings comprises a blind hole, of a depth such that in use the helical wire touches the inner end of each opening.

4. Locating means according to claim 3 in which each opening is of part-spherical shape.

5. Locating means according to claim 1 in which the operative face of each body is formed with a groove which extends along the central part of the row of openings or other locating formations, the two grooves co-operating to form a longitudinal channel when the bodies are in face-to-face relationship, whereby a wire or other article disposed in the channel when the locating means are in use is embraced by the helical wire.

* * * * *